US005911542A

United States Patent [19]

Obrock et al.

[11] Patent Number: 5,911,542

[45] Date of Patent: Jun. 15, 1999

[54] UNSINKABLE FLOATING DOCK SYSTEM

[75] Inventors: William L. Obrock; John O. Kjar, both of St. Louis, Mo.

[73] Assignee: Diamond Dock, L.L.C., St. Louis, Mo.

[21] Appl. No.: 08/791,324

[22] Filed: Jan. 31, 1997

[51] Int. Cl.[6] ..... E02B 3/06; B63B 35/44

[52] U.S. Cl. ..... 405/219; 114/267; 405/118; 441/29; 441/9

[58] Field of Search ..... 405/218–221, 405/212, 25–27; 114/267, 266, 52, 53, 125; 441/9, 10, 29

[56] References Cited

U.S. PATENT DOCUMENTS

| | | | |
|---|---|---|---|
| 2,858,790 | 11/1958 | Russell, Jr. . | |
| 3,000,021 | 9/1961 | Lang | 405/212 X |
| 3,073,271 | 1/1963 | Brill | 114/266 |
| 3,197,963 | 8/1965 | Frederiksen | 405/25 |
| 3,276,209 | 10/1966 | Mosdell | 405/27 |
| 3,323,479 | 6/1967 | Filak . | |
| 3,426,109 | 2/1969 | Dempster | 114/267 X |
| 3,673,975 | 7/1972 | Strauss | 114/267 X |
| 3,777,689 | 12/1973 | Olsen et al. | 405/26 X |
| 3,823,564 | 7/1974 | Crout et al. | 405/204 |
| 3,864,920 | 2/1975 | Tazaki et al. | 405/27 |
| 4,487,151 | 12/1984 | Deiana . | |
| 4,920,907 | 5/1990 | Richter | 405/212 X |
| 4,938,629 | 7/1990 | Boudrias | 405/219 X |
| 5,031,564 | 7/1991 | Beckerer | 405/212 X |
| 5,192,161 | 3/1993 | Helgesson et al. . | |
| 5,347,948 | 9/1994 | Rytand | 405/219 X |
| 5,375,550 | 12/1994 | Innis . | |
| 5,404,825 | 4/1995 | McElwain . | |
| 5,775,248 | 7/1998 | Simola | 114/267 |

FOREIGN PATENT DOCUMENTS

| | | | |
|---|---|---|---|
| 948933 | 6/1974 | Canada | 114/267 |
| 0249795 | 10/1990 | Japan | 441/9 |

*Primary Examiner*—Dennis L. Taylor
*Attorney, Agent, or Firm*—Summers, Compton, Wells & Hamburg, P.C.

[57] ABSTRACT

A dock module comprises an air-tight flotation chamber with a buoyant foam material positioned within an upper end thereof. The flotation chamber includes aperture positioned on its bottom end to permit water to enter the chamber and serve as a ballast. To float the dock module, compressed air is injected into the flotation chamber to increase the module's buoyancy and adjust its freeboard so that the buoyant foam is lifted completely above the water contained within the flotation chamber. If the air-tight flotation chamber fails, the buoyant foam will prevent the dock module from becoming submerged. Each module comprises a plurality of longitudinally and laterally extending tubes that can be used to attach the module to a like module using tubular couplers and tensioned cabling. Multiple modules can thus be joined in any desired configuration to yield a floating dock system having virtually any desired geometry.

7 Claims, 5 Drawing Sheets

UNSINKABLE FLOATING DOCK SYSTEM

BACKGROUND OF THE INVENTION

1. Field of the Invention

The present invention relates to floating docks and, more particularly, to a modular floating dock system having an adjustable freeboard and a backup source of flotation.

2. Description of the Related Art

Although there are a large number and a wide variety of floating docks in present use, including both swimming docks and boat docks, nearly all of these floating docks are disadvantaged in one or more significant respects. For example, most floating docks rely on buoyant foam for floating the dock, even though the foam materials employed were not developed for this purpose. Using foam for floating a dock necessarily requires the foam to be immersed in water. When so immersed, the foam absorbs water and ultimately deteriorates, thereby requiring the foam to be periodically replaced—every six to eight years on average. In addition, beads or pieces of foam can break loose and pollute the marine environment. For this reason, recently promulgated regulations require the foam used in floating docks to be encapsulated. The encapsulated foam, however, costs as much as three times that of unencapsulated foam without overcoming many of the problems associated therewith. Since the encapsulation is typically not water-tight, the encapsulated foam still absorbs water in the same manner as unencapsulated foam. Consequently, encapsulated foam has the same perishable life as unencapsulated foam and must be periodically replaced, but at a significantly greater cost than in years past. For all of these reasons, the economies of floating docks using buoyant foams are suffering greatly.

Another problem associated with the various floating docks of the prior art is that the docks have no means for adjusting the level of flotation. As is well-known, the loads borne by a floating dock vary both seasonably and geographically as a result of snow, wind, and other conditions. The docks are ordinarily designed to have an amount of freeboard (i.e., the portion of the dock above the water level) complementary to the dock's intended use. For example, a floating boat dock is usually designed to have a freeboard sufficient to accommodate boats within a predetermined range of sizes. During winter months, however, this freeboard can be altered dramatically by snow loads which, in combination with a typical dock's insufficient strength, can result in a structural failure where the dock will first list and then collapse. Moreover, because most prior art docks are provided with only a single means for flotation, the docks will become submerged upon collapsing, thereby making retrieval or restoration of the dock unduly burdensome. Further still, it is well-known that the loads borne by different regions of a dock are seldom the same. Thus, even where a desired amount of freeboard is obtained for one region of the dock, the uneven loads can result in a different and undesirable amount of freeboard at a different region.

Still another problem with prior art docks relates to the manner in which the docks are constructed. The current construction approach is simply an accumulation of many independent systems in a non-integrated fashion. For example, a framework is usually constructed first for the flotation means. Another framework or subfloor is then constructed and attached to the framework for the flotation means, followed by the deck or floor itself. After electrical or plumbing utilities are installed, various covers or shields may then be constructed to conceal and protect the utilities. Thus, each functional component of the dock is independently constructed and then bolted or otherwise attached to the other components. Due to this primitive approach to dock construction, a needless amount of materials are employed, thereby rendering the dock excessively heavy and unnecessarily expensive. Further, the various dock components are oftentimes constructed and assembled in the same manner as static, land-based structures despite the dynamic conditions the dock will experience in use, thereby rendering the dock insufficiently strong. Further still, docks are commonly constructed with ordinary wood or steel components despite the highly corrosive nature of the dock environment. The prior art's cumbersome approach to dock construction also requires the dock to be constructed from the "ground up" at the desired dock site, even though constructing the dock in this environment, i.e., within a body of water, is far from convenient. Most prior art docks also have a rectangular shape with sharp corners that can seriously damage boats, for example, that collide with the sharp corners.

What is needed is a floating dock system having an integrated design which gives the dock a superior strength while using a minimum of materials, thereby reducing the cost and weight of the dock. Such a dock system should avoid the use of immersed foam materials, and should include a back-up source of flotation to prevent the dock from becoming submerged in the event of a failure. Such a floating dock system should also have an adjustable flotation, both for the dock as a whole as well as for individual regions thereof, so the freeboard of the dock can be adjusted for uneven or varying load conditions. The dock should be constructed of non-corrosive materials so as to increase the life of the dock and thus decrease its cost when averaged over the dock's useable life. Furthermore, such a floating dock system would ideally employ a modular design approach to permit manufacture of the modules on a large scale, off-site basis, thereby further reducing the cost of the dock. A modular approach would also simplify assembly of the dock at the desired dock location, and would allow multiple modules to be selectively assembled so as to yield a dock having any desired geometry.

SUMMARY OF THE INVENTION

The inventors hereof have succeeded at solving these and other needs in the art by designing a modular floating dock system having a superior strength and indefinite usable life, but with a minimum of materials and costs. The floating dock system is assembled from multiple dock modules, where each dock module comprises a flotation chamber that is air-tight when in use, and a buoyant foam material positioned within an upper end of the flotation chamber. To float a dock module, a compressed gas is injected into the flotation chamber to increase the module's buoyancy and thus adjust its freeboard. The flotation chamber includes apertures positioned on its bottom end to permit water to enter the chamber and serve as a ballast, thereby dampening the effect of waves on the floating dock module. The flotation chamber is dimensioned so that when it is pressurized with a gas to obtain the desired amount of freeboard, the buoyant foam is lifted completely above the water contained within the flotation chamber. The buoyant foam thus remains dry and does not deteriorate. However, in the event of a failure in the air-tight flotation chamber, which would cause the module to sink, the buoyant foam will be placed into the water contained within the flotation chamber and will prevent the dock module from becoming submerged.

The preferred dock module comprises a plurality of longitudinally and laterally extending tubes that can be used to attach the sides or ends of the module to a like module using tubular couplers and tensioned cabling. The tubular couplers are inserted into the ends of the tubes of two modules to join the modules together, and the cabling is routed through the tubes and couplers and then tensioned to prevent the modules from separating. In this manner, multiple modules can be selectively joined to yield a floating dock system having virtually any desired geometry. In addition, the air pressure in multiple modules can be collectively or individually adjusted to adjust the freeboard for the overall dock, or just for individual regions thereof. The framework of the combined dock modules also include raceways through which unsightly electrical, plumbing, and air lines can be routed in a concealed and protected fashion without requiring separate covers or shields.

While the principal advantages and features of the present invention have been described above, a more complete and thorough understanding of the invention may be attained by referring to the drawings and description of the preferred embodiments which follow.

DETAILED DESCRIPTION OF THE PREFERRED EMBODIMENT

Figure 1:
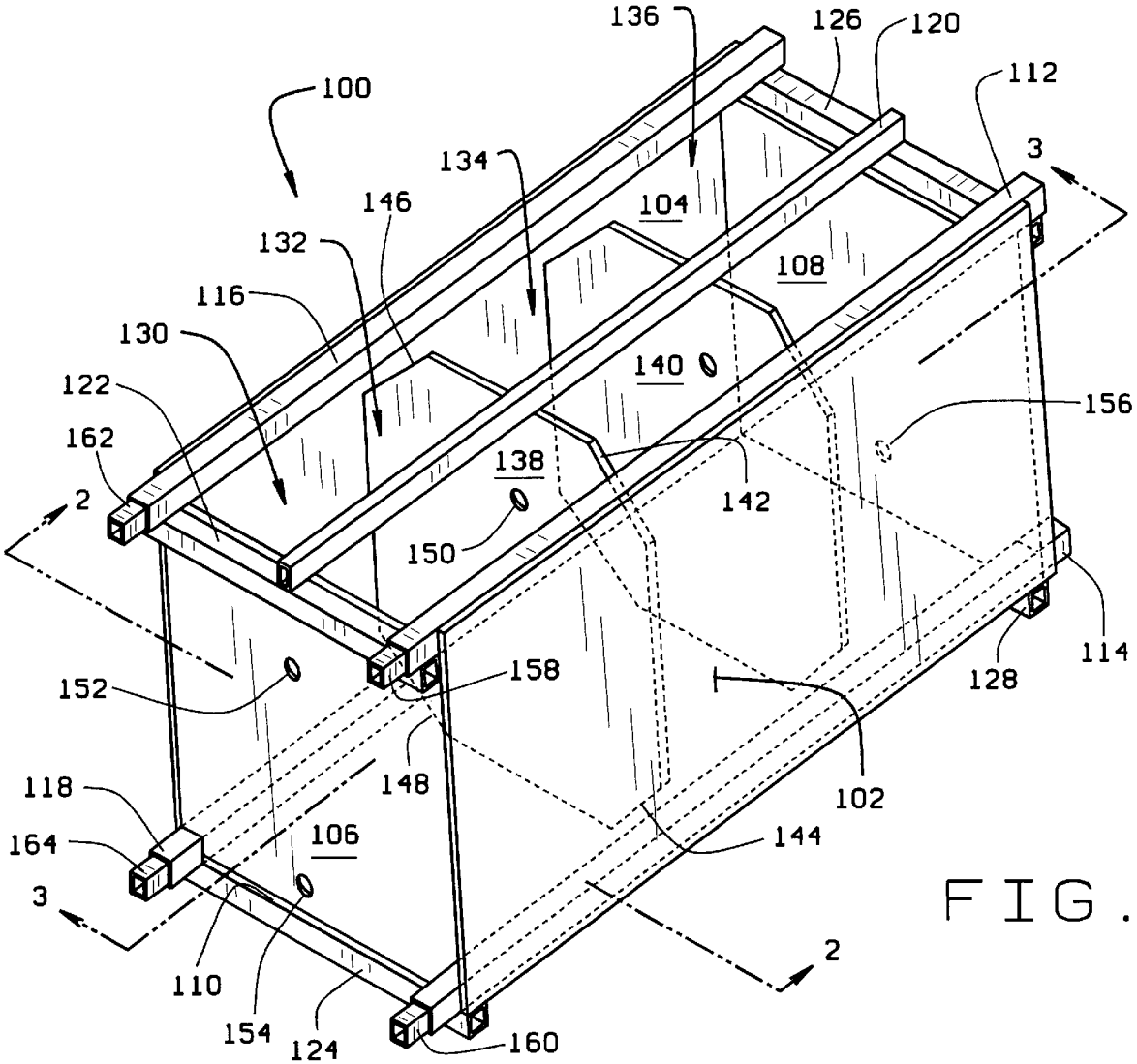
FIG. 1 is an isometric view of the framework for a dock module according to the present invention.

The framework for a preferred floating dock module in accordance with the present invention is illustrated in FIG. 1, and is designated generally by the reference character 100. The framework 100 includes two side panels 102, 104, two end panels 106, 108, and a bottom panel 110. As shown, the framework 100 also includes four tubes 112, 114, 116, 118 that extend longitudinally along top and bottom portions of the side panels 102, 104, as well as an additional tube 120 extending longitudinally between the tubes 112, 116. Another four tubes 122, 124, 126, 128 extend laterally along top and bottom portions of the end panels 106, 108. The side panels 102, 104, the end panels 106, 108, and the bottom panel 110 together define a flotation chamber 130, which itself is divided into three subchambers 132, 134, 136 by two stiffening panels 138, 140 extending laterally between the side panels 102, 104. The stiffening panels 138, 140 each have diagonal corners 142, 144, 146, 148 so that each subchamber 132–136 is in fluid communication with the other subchambers. For this same purpose, each stiffening panel 138, 140 includes an aperture 150 extending through a center region thereof. The end panel 106 includes an aperture 152 extending through a center region thereof to permit a pressurized gas to be injected into the flotation chamber 130, as further explained below. Both of the end panels 106, 108 include an aperture 154, 156, respectively, extending through a bottom region thereof to permit water to enter the flotation chamber 130 when the completed dock module is placed in a body of water.

FIG. 1 also illustrates four tubular couplers 158, 160, 162, 164 received within the ends of the longitudinally extending tubes 112–118. As should be apparent, and as explained further below, the tubular couplers 158–164 allow the framework 100 to be joined with the framework of a like dock module at the end regions thereof. Alternatively, or additionally, tubular couplers can be received within the ends of the laterally extending tubes 122–128 to join the framework 100 with the framework of a like module along the side regions thereof. In the preferred embodiment, all of the tubes and panels are formed from stainless steel so as to resist corrosion when placed in a marine environment. The preferred framework 100 has a longitudinal length of eight feet, a lateral width of four feet, and a height of four feet. The longitudinally extending tubes 112–118 and the laterally extending tubes 122–128 preferably have a rectangular cross section, and comprise three inch by three inch square tubes with a one-quarter inch thickness. The longitudinally extending tube 120 preferably has a rectangular cross section and a one and one-half inch by three inch dimension. As an alternative to the preferred embodiment, tubes having a circular or other cross-sectional shape can be used with similar effect. All of the tubes and panels are preferably joined together in a rigid, fluid-type manner, such as by welding.

Figure 2:
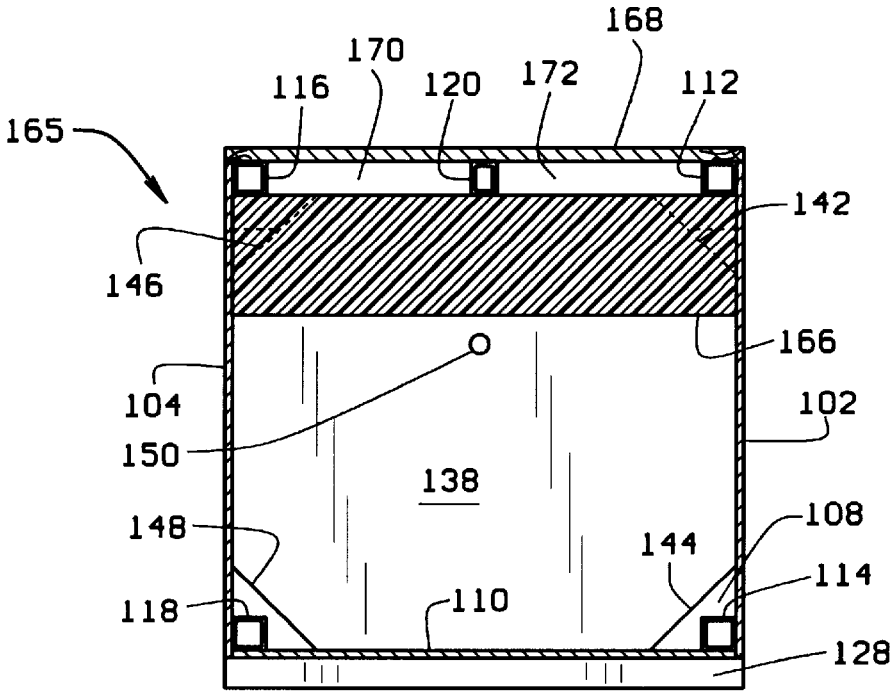
FIG. 2 is a cross-sectional view of a complete dock module taken through line 2—2 shown in FIG. 1.

FIG. 2 illustrates a sectional view of a complete dock module 165 having the framework 100 illustrated in FIG. 1. As shown, the complete dock module 165 includes a buoyant foam material 166 and a deck 168. The foam material 166 is positioned within an upper end of the flotation chamber 130, and fills the entire upper region of each subchamber 132–136. The preferred foam material 166 is a closed-cell foam that provides an air-tight seal for the upper end of the flotation chamber 130, and has a greater buoyancy and longevity than open-cell foams. Alternatively, an open-cell foam can be used in conjunction with an additional panel extending across and sealing the top end of the flotation chamber 130. In the inventors' preferred embodiment, the foam material 166 has a height dimension of fourteen inches. The deck 168 is attached to top sides of the longitudinally extending tubes 112, 116, 120, as explained further below, and preferably comprises three-quarter inch plywood of a type suitable for use in a marine environment.

Figure 3:
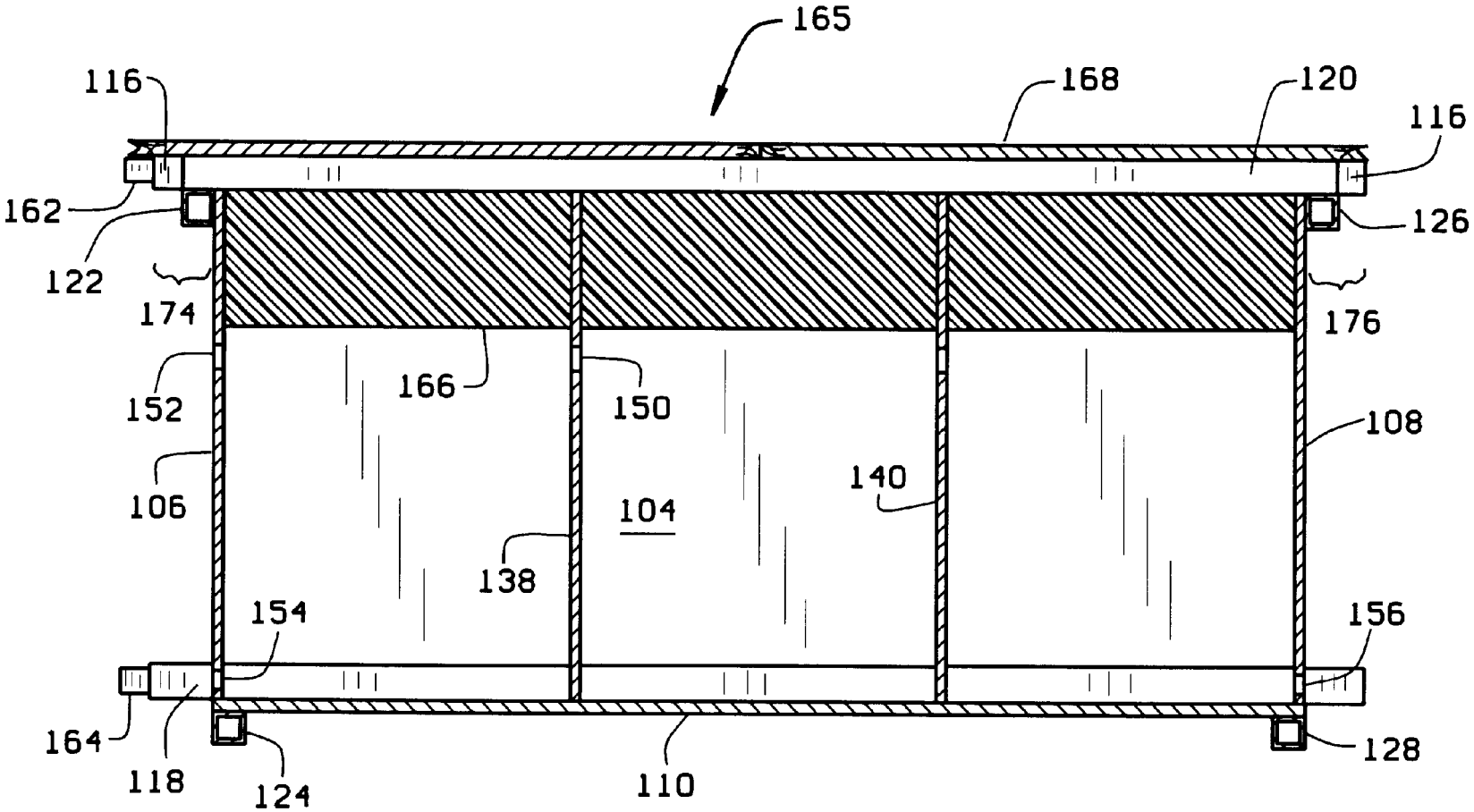
FIG. 3 is a cross-sectional view of a complete dock module taken through line 3—3 shown in FIG. 1.

As shown in FIG. 2, the top longitudinally extending tubes 112, 116, 120 define a pair of longitudinally extending raceways 170, 172 therebetween through which electrical wiring, water pipes, pressurized air lines, etc. can be routed as may be needed in a completed floating dock system. FIG. 3 depicts a sectional view taken through the length of the complete dock module 165, and illustrates the longitudinal tubes 112–118 as extending beyond the end panels 106, 108. Similarly, the lateral tubes 122–128 are positioned on exterior sides of the end panels 106, 108. As a result of this structural configuration, space 174, 176 exists adjacent to the end panels 106, 108 for routing electrical or other utilities along either end of the complete dock module 165, even when the module is connected to a like module along the end regions thereof. Thus, the raceways 170, 172 and the space 174, 176 can be used to hide and protect unsightly utilities in a floating dock system assembled from multiple dock modules 165.

Figure 4:
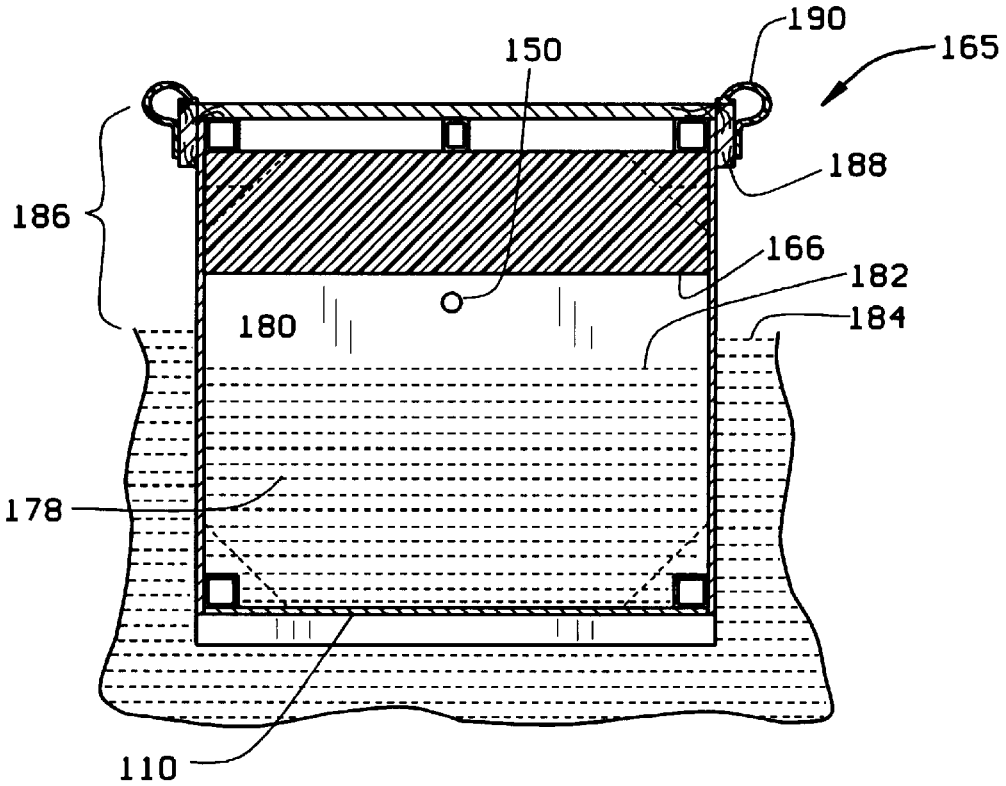
FIG. 4 is a cross-sectional view similar to FIG. 2 but showing the dock module in use.

When placed in a body of water, water will enter the flotation chamber 130 through the apertures 154, 156 extending through the end panels 106, 108. As a result, the water 178 contained within the flotation chamber 130, as shown in FIG. 4, will act as a ballast or sea anchor to dampen the effect of waves on the dock module, as apparent to those skilled in the art. A pressurized gas 180 can then be injected into the flotation chamber 130 through the aperture 152 extending through the end panel 106. Due to the aperture 150 extending through each stiffening panel 138, 140, the gas pressure in each subchamber 132–136 will be the same, and will force some of the contained water 178 out of the flotation chamber 130 such that an interior water level 182 for the module will be lower than an exterior water level 184, as shown in FIG. 4. The pressurized gas 180 will also increase the buoyancy of the dock module 165, and will cause the dock to rise with respect to the exterior water level 184, thereby increasing the dock's freeboard 186. In this manner, the freeboard 186 of the dock module 165 can be adjusted to a desired level by varying the amount of pressurized gas 180 injected into the flotation chamber 130. In the preferred embodiment, the pressurized gas is simply ambient air pressurized by a conventional compressor. It should be understood, however, that other types of gases and pressurizing means can be employed without departing from the teachings of the present invention. Additionally, while the pressurized gas is introduced into the flotation chamber through the aperture 152 positioned in a center region of the end panel 106, other approaches to introducing the pressurized gas can be used with similar effect. For example, the gas could instead be introduced through the bottom panel 110 of the dock module, and bubbled up through the contained water 178.

The preferred dock module 165 is sized and dimensioned for its intended application and anticipated loads so that when the desired amount of freeboard 186 is obtained by introducing an appropriate amount of pressurized gas 180 into the flotation chamber 130, the buoyant foam material 166 is lifted completely above the interior water level 182, as shown in FIG. 4. As a result, the foam material is kept dry and will resist deterioration, and need not be periodically replaced. In the event the air-tight seal of the flotation chamber 130 is breached, and the pressurized gas 180 is released, the buoyant foam material 166 will float the dock module 165 at a minimal level and will prevent the module from becoming submerged. In this manner, the foam material 166 serves as a backup source of flotation. FIG. 4 also illustrates an optional bumper skirt 188 and a vinyl bumper 190 that can be attached along the upper side edges of those portions of the dock module 165 that are not attached to a like module or to a rounded bumper further described below. The bumper skirt 188 and the vinyl bumper 190 protect the dock module 165 from colliding objects such as boats, and vice versa.

Figure 5:
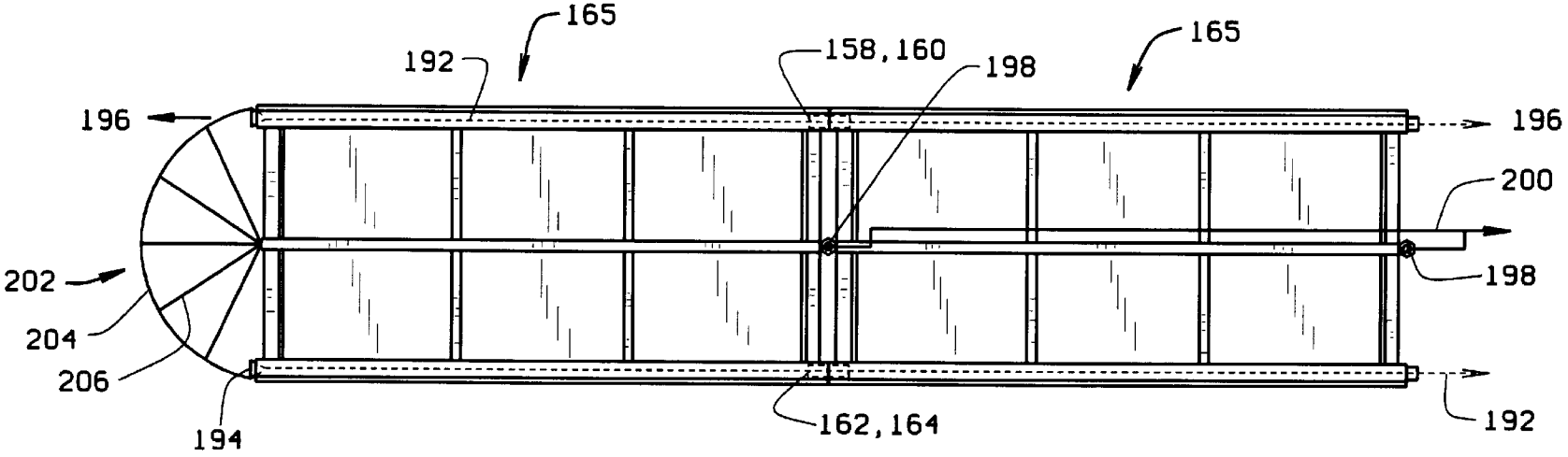
FIG. 5 is a plan view showing the assembly of multiple dock modules.

To attach the dock module 165 to a like module, the tubular couplers 158–164 are first inserted into the ends of the longitudinal tubes 112–118 (or the lateral tubes 122–128) for each module, as shown in FIG. 5. Cabling 192 is routed through both the tubing 112–118 and the couplers 158–164, and then tensioned using a hydraulic motor or any other suitable means known in the art to rigidly hold the multiple modules together. For this purpose, chucks 194 are used to secure the ends of the cabling 192, where the chucks are sized to engage the ends of the tubes 112–118. The chucks 194 are preferably of the type that permit the cabling to be pulled through the chucks in the tensioning direction 196, but prevent movement of the cabling in an opposite direction, as well-known in the art. The size and type of the cabling 192 and the chucks 194 depend upon the number of modules to be interconnected, the dimensions of the modules, and the loads expected to be borne thereby.

As shown in FIG. 5, each module 165 has a pair of valves 198 associated therewith, and positioned adjacent to the aperture 152 extending through the end panel 106. Each valve pair 198 is attached to the valve pairs associated with other modules via an air line 200, as described further below. FIG. 5 also illustrates a rounded bumper 202 attached to the end of one of the modules 165. The rounded bumper includes a semi-circular surface 204 supported by several gussets 206, and protects boats and other objects from damage that might otherwise occur if these objects collided with one of the corners of a dock module. The rounded bumper 202 is preferably formed from stainless steel, like the modules 165, so as to resist corrosion.

Figure 6:
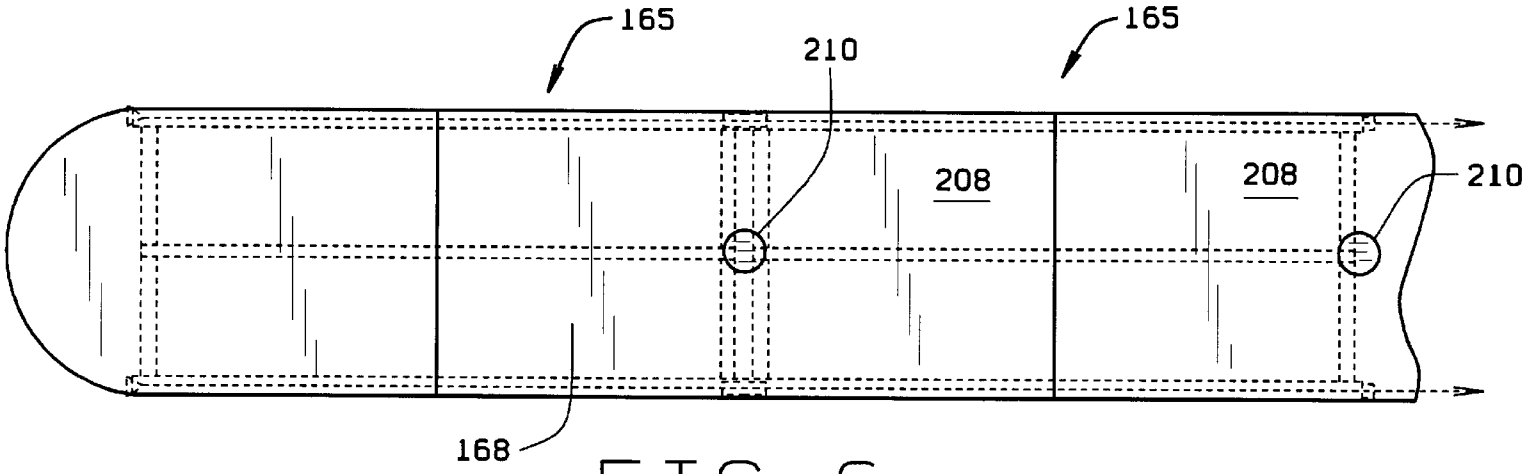
FIG. 6 is a plan view similar to FIG. 5 after a deck is attached to the multiple dock modules.
Figure 7:
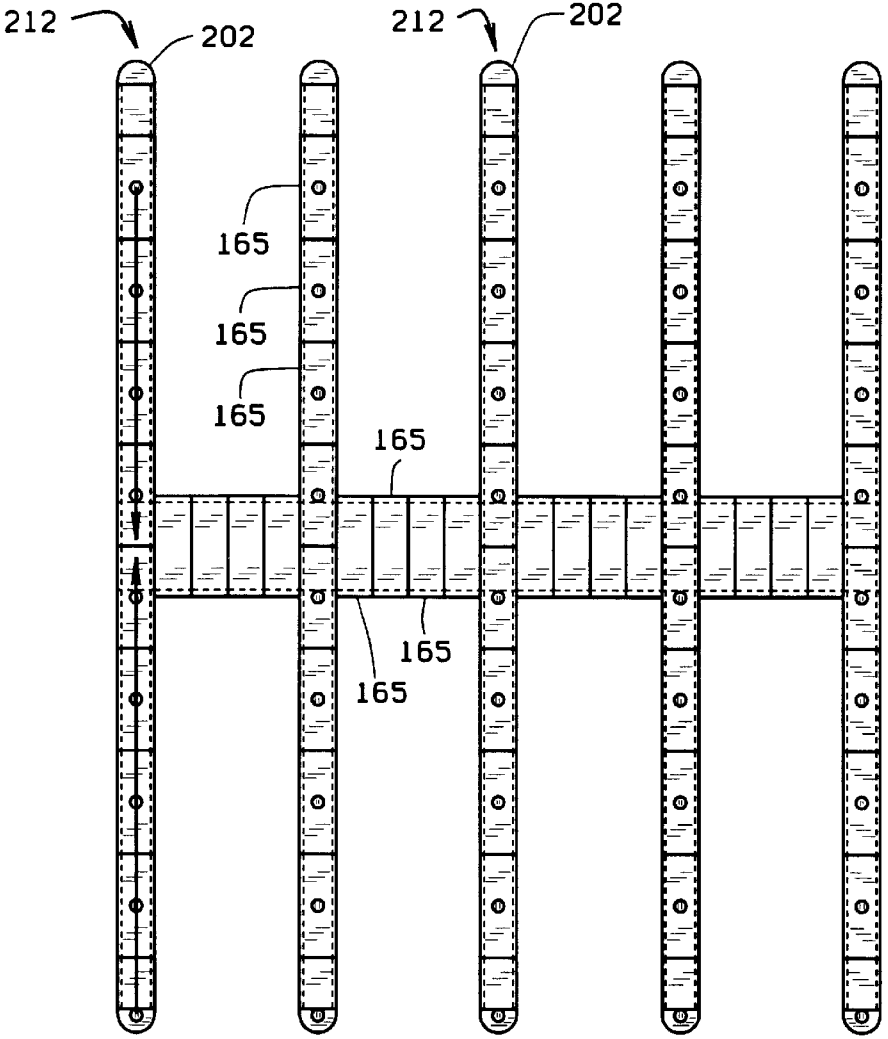
FIG. 7 is a plan view of a representative floating dock system according to the present invention.

FIG. 6 illustrates the dock modules 165 shown in FIG. 5 after the deck 168 has been attached using corrosion-resistant deck screws or other suitable fasteners. The deck preferably comprises four by eight sheets of plywood 208, where each piece of plywood 208 preferably overlaps two adjacent modules 165, thereby further contributing to the strength and rigidity of the floating dock system. Access covers 210 are placed over holes formed in the plywood 208 above the valve pair 198 associated with each module 165, and provide access for routing, connecting, and servicing the various utilities required in the floating dock system. FIG. 7 illustrates a representative floating dock system constructed from multiple modules 165 to form a number of boat slips 212, where the end of each boat slip 212 has a rounded bumper 202 attached thereto.

Figure 8:
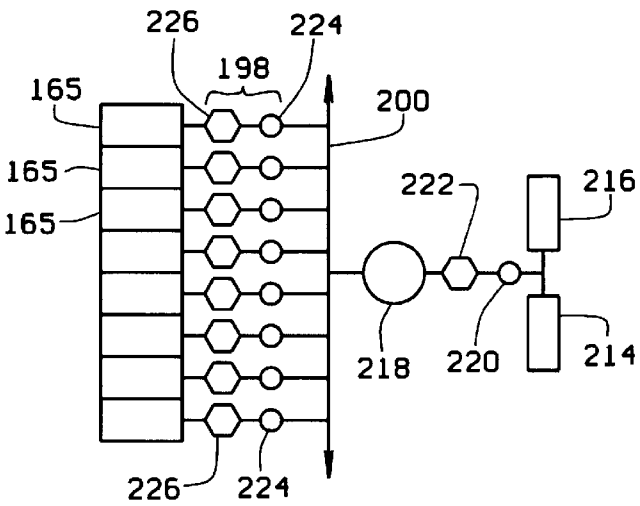
FIG. 8 is a schematic of a compressed air system.

The compressed air system for the floating dock system of FIG. 7 is shown schematically in FIG. 8, and includes a primary air compressor 214, a standby air compressor 216, and a high pressure tank 218. The air compressors are preferably twelve volt pumps with battery backups, and provide compressed air to the tank 218 through a check valve 220 and a pressure regulator 222, where the pressure regulator prevents the pressure within the tank 218 from exceeding a predetermined level. FIG. 8 also illustrates the air line 200 that interconnects the tank 218 to each dock module 165 through the valve pair 198 associated with each module. As shown, each valve pair 198 includes a check valve 224 and a pressure regulator 226. In the preferred embodiment, the pressure in the tank 218 is maintained at a level slightly greater than the maximum pressure required to float the dock modules 165 with a desired amount of freeboard 186. Additionally, if the freeboard at one region of the dock differs from the freeboard at another region, the pressure in one or more of the modules 165 can be decreased using the pressure regulators 226 so as to obtain a uniform amount of freeboard across the entire floating dock system.

It should be appreciated from the foregoing description that the preferred dock module 165 is the result of an integrated design approach that yields several significant advantages. The framework 100, which defines the flotation chamber 130, also serves as a support for the deck 168, which itself contributes to the strength and rigidity of the floating dock system, while also providing a means for joining like modules together using the longitudinally or laterally extending tubes. The various utilities for the floating dock system can be concealed and protected, and the freeboard for independent regions of the dock, as well as the dock as a whole, can be selectively adjusted. The modular approach of the present invention permits the dock modules to be conveniently constructed off-site, and then quickly assembled at the desired dock location. Further still, the position of the buoyant foam material in each dock module overcomes the problems associated with prior art docks relying on foam flotation, while providing a backup source of flotation. The net result is a floating dock system having a superior strength, utility, safety, and usable life, but with a minimum of materials and cost.

There are various changes and modifications which may be made to the invention as would be apparent to those skilled in the art. However, these changes or modifications are included in the teaching of the disclosure, and it is intended that the invention be limited only by the scope of the claims appended hereto, and their equivalents.

What is claimed is:

1. A dock comprising a flotation chamber having at least one opening, the opening being located on a portion of the flotation chamber that is positioned below water level when the dock is placed in a body of water, the opening thereby permitting water to enter into and be contained by the flotation chamber when the dock is in said body of water, and a buoyant material positioned within the flotation chamber and capable of floating the dock, the flotation chamber being adapted for containing an amount of pressurized gas sufficient to float the dock in said body of water with the buoyant material positioned above at least the water level in the flotation chamber, the buoyant material thereby serving as a backup source of flotation for the dock.

2. The dock of claim 1 wherein the buoyant material seals an upper end of the flotation chamber.

3. The dock of claim 2 wherein the floatation chamber comprises substantially all of the dock.

4. The dock of claim 3 further comprising a source of pressurized air.

5. The dock of claim 4 wherein the flotation chamber is divided into a plurality of subchambers, each subchamber is in fluid communication with another subchamber, and the buoyant material is positioned within one of the subchambers.

6. The dock of claim 5 wherein each subchamber has a buoyant material positioned therein.

7. The dock of claim 6 wherein the flotation chamber is constructed from stainless steel.

* * * * *